US011417306B2

(12) United States Patent
Aval

(10) Patent No.: US 11,417,306 B2
(45) Date of Patent: Aug. 16, 2022

(54) SYSTEMS AND METHODS FOR ENGINE HARMONIC CANCELLATION

(71) Applicant: Bose Corporation, Framingham, MA (US)

(72) Inventor: Yashar Aval, Belmont, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 17/139,263

(22) Filed: Dec. 31, 2020

(65) Prior Publication Data

US 2022/0208164 A1 Jun. 30, 2022

(51) Int. Cl.
*G10K 11/178* (2006.01)

(52) U.S. Cl.
CPC .... *G10K 11/178* (2013.01); *G10K 2210/1282* (2013.01)

(58) Field of Classification Search
CPC ..... G10K 15/02; G10L 21/0272; G10L 25/51; G10L 25/84; H04R 1/025; H04R 1/08; H04R 3/00; H04R 2430/01; H04R 2499/13
USPC ..... 381/56, 57, 58, 71.1, 71.4, 86, 389
See application file for complete search history.

(56) References Cited

U.S. PATENT DOCUMENTS 5,953,428 A 9/1999 Silverberg et al.
6,493,689 B2 12/2002 Kotoulas et al.
7,224,807 B2 5/2007 Welsh et al.
8,600,069 B2 * 12/2013 Lee ..... G10K 11/17823 381/86
9,153,226 B2 10/2015 Wurm
10,121,464 B2 11/2018 Lee et al.
2002/0118844 A1 8/2002 Welsh et al.
2010/0014685 A1 * 1/2010 Wurm ..... G10K 11/17823 381/71.11
2011/0235693 A1 * 9/2011 Lee ..... H04S 7/00 375/224
2012/0134506 A1 * 5/2012 DeBiasio ..... H04R 3/12 381/86

(Continued)

OTHER PUBLICATIONS

International Search Report and the Written Opinion of the International Searching Authority, International Patent Application No. PCT/US2021/073130, pp. 1-13, dated Mar. 23, 2022.

*Primary Examiner* — William A Jerez Lora
(74) *Attorney, Agent, or Firm* — Bond, Schoeneck & King, PLLC

(57) ABSTRACT

An engine harmonic cancellation system includes an accelerometer disposed within a vehicle to detect a harmonic produced by an engine of the vehicle and to produce a harmonic reference signal representative of the harmonic; a controller configured to produce a harmonic cancellation signal that, when transduced into an acoustic signal, cancels the harmonic within at least one cancellation zone within a cabin of the vehicle, wherein the harmonic cancellation signal is based, at least in part, on mixing the harmonic reference signal converted to baseband with a baseband signal output from a look up table; and a speaker disposed within the cabin and configured to receive the harmonic cancellation signal and to transduce the harmonic cancellation signal into an acoustic harmonic cancellation signal, such that the harmonic is cancelled within the cancellation zone.

20 Claims, 6 Drawing Sheets

(56) References Cited

U.S. PATENT DOCUMENTS

| | | | | |
|---|---|---|---|---|
| 2016/0005308 | A1* | 1/2016 | Kohlrausch | H04R 29/007 381/57 |
| 2016/0284334 | A1* | 9/2016 | Hera | G10K 15/02 |
| 2018/0025717 | A1* | 1/2018 | Ku | G10K 11/17854 381/71.11 |
| 2019/0270350 | A1 | 9/2019 | Bastyr et al. | |
| 2020/0118539 | A1* | 4/2020 | Wolf | B60L 15/08 |
| 2020/0357378 | A1 | 11/2020 | Bastyr et al. | |

* cited by examiner

SYSTEMS AND METHODS FOR ENGINE HARMONIC CANCELLATION

BACKGROUND

The present disclosure generally relates to systems and methods for cancelling engine harmonics.

SUMMARY

All examples and features mentioned below can be combined in any technically possible way.

According to an aspect, an engine harmonic cancellation system, includes: an accelerometer disposed within a vehicle to detect a harmonic produced by an engine of the vehicle and to produce a harmonic reference signal representative of the harmonic; a controller configured to produce a harmonic cancellation signal that, when transduced into an acoustic signal, cancels the harmonic within at least one cancellation zone within a cabin of the vehicle, wherein the harmonic cancellation signal is based, at least in part, on mixing the harmonic reference signal converted to baseband with a baseband signal output from a look up table; and a speaker disposed within the cabin and configured to receive the harmonic cancellation signal and to transduce the harmonic cancellation signal into an acoustic harmonic cancellation signal, such that the harmonic is cancelled within the cancellation zone.

In an example, the controller implements a down converter configured to receive the harmonic reference signal and to output the harmonic reference signal converted to baseband.

In an example, the baseband signal has an amplitude and a phase, wherein the amplitude is selected to be a constant ratio with an amplitude of the harmonic reference signal converted to baseband, wherein the phase is equal to a phase of the harmonic cancellation signal when summed with a phase of the harmonic reference signal converted to baseband.

In an example, the controller implements a multiplier, wherein the multiplier mixes the harmonic reference signal converted to baseband with the baseband signal output from the look up table to output a baseband harmonic cancellation signal, wherein the controller further implements an up converter configured to receive the baseband harmonic cancellation signal and to up convert the baseband harmonic cancellation signal to output the harmonic cancellation signal.

In an example, the engine harmonic cancellation system further includes an error sensor disposed to produce an error signal representative of a residual harmonic in the cabin of the vehicle, wherein a value of the look up table is updated according to the error signal.

In an example, the error sensor is disposed outside of the cancellation zone, wherein the controller is further configured to implement a projection filter configured to estimate a value of the residual harmonic within the cancellation zone.

In an example, the controller implements a multiplier, wherein the multiplier mixes the harmonic reference signal converted to baseband with the baseband signal output from the look up table to output an intermediate baseband harmonic cancellation signal, wherein the controller further implements a second look up table and a second multiplier, wherein the second multiplier mixes the intermediate baseband harmonic cancellation signal with an output from the second look up table to produce a baseband harmonic cancellation signal.

In an example, a value of the look up table and a value of the second look up table is updated according to an error signal from an error sensor, representative of a residual harmonic in the vehicle cabin, wherein the second look up table is updated to adapt faster to changes in a transfer function between the speaker and the cancellation zone than the look up table.

In an example, a value of the look up table and a value of the second look up table is updated according to an error signal from an error sensor, representative of a residual harmonic in the vehicle cabin, wherein the look up table is updated to adapt faster to changes in a transfer function between the speaker and the cancellation zone than the second look up table.

In an example, the look up table is configured to select a first value at a first torque value and a second value at a second torque value.

According to an aspect, a method for cancelling engine harmonics in a vehicle cabin, includes the steps of: receiving a harmonic reference signal representative of a harmonic produced by an engine of the vehicle from an accelerometer disposed within a vehicle to detect the harmonic; producing a harmonic cancellation signal that, when transduced into an acoustic signal, cancels the harmonic within at least one cancellation zone within a cabin of the vehicle, wherein the harmonic cancellation signal is based, at least in part, on mixing the harmonic reference signal converted to baseband with a baseband signal output from a look up table; and providing the harmonic cancellation signal to a speaker disposed within the cabin and configured to receive the harmonic cancellation signal to transduce the harmonic cancellation signal into an acoustic harmonic cancellation signal, such that the harmonic is cancelled within the cancellation zone.

In an example, the method further includes the step of down converting the harmonic reference signal to output the harmonic reference signal converted to baseband.

In an example, the baseband signal has an amplitude and a phase, wherein the amplitude is selected to be a constant ratio with an amplitude of the harmonic reference signal converted to baseband, wherein the phase is equal to a phase of the harmonic cancellation signal when summed with a phase of the harmonic reference signal converted to baseband.

In an example, the method further includes the steps of: mixing the harmonic reference signal converted to baseband with the baseband signal output from the look up table to output a baseband harmonic cancellation signal; and up converting the baseband harmonic cancellation signal to output the harmonic cancellation signal.

In an example, the method further includes the step of updating a value of the look up table is according to an error signal received from an error sensor disposed to produce an error signal representative of a residual harmonic in the vehicle cabin.

In an example, the method further includes the step of estimating a value of the residual harmonic within the cancellation zone, wherein the error sensor is disposed outside of the cancellation zone.

In an example, the method further includes the step of: mixing the harmonic reference signal converted to baseband with the baseband signal output from the look up table to output an intermediate baseband harmonic cancellation signal, mixing the intermediate baseband harmonic reference signal with the output from a second look up table to produce a baseband harmonic reference signal.

In an example, the method further includes the step of updating a value of the look up table and a value of the second look up table according to an error signal from an error sensor, representative of a residual harmonic in the vehicle cabin, wherein the second look up table is updated to adapt faster to changes in a transfer function between the speaker and the cancellation zone than the look up table.

In an example, the method further includes the step of updating a value of the look up table and a value of the second look up table according to an error signal from an error sensor, representative of a residual harmonic in the vehicle cabin, wherein the look up table is updated to adapt faster to changes in a transfer function between the speaker and the cancellation zone than the second look up table.

In an example, the look up table is configured to select a first value at a first torque value and a second value at a second torque value.

The details of one or more implementations are set forth in the accompanying drawings and the description below. Other features, objects, and advantages will be apparent from the description and the drawings, and from the claims.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the various aspects.

DETAILED DESCRIPTION

Vehicle engines (including both internal combustion engines and electric motors) generate pronounced harmonics (sounds emitted at integer multiples of a fundamental frequency) during operation, often due to the rotation of various elements within the engine, such as the crankshaft.

Road noise cancellation systems are not well adapted for cancelling engine harmonics because the road noise tends to dominate the engine harmonics while the vehicle is in motion, thus road noise cancellation system will tend to adapt the dominant road noise and leave the engine harmonics uncancelled. Furthermore, finite impulse response filters, such as those typically employed in road noise cancellation systems, often cannot capture rapid changes in engine harmonic, such as those that occur when the engine is revved.

In addition, previous engine harmonic cancellation systems tended to rely on the use of a microphone disposed in the cabin to detect the engine harmonics to be cancelled. But these systems relied on a feedback signal from an error sensor, such as a microphone, for detecting both the cabin acoustics and the amplitude and phase of the harmonic, limiting the adaptability and accuracy of such systems.

Figure 1:
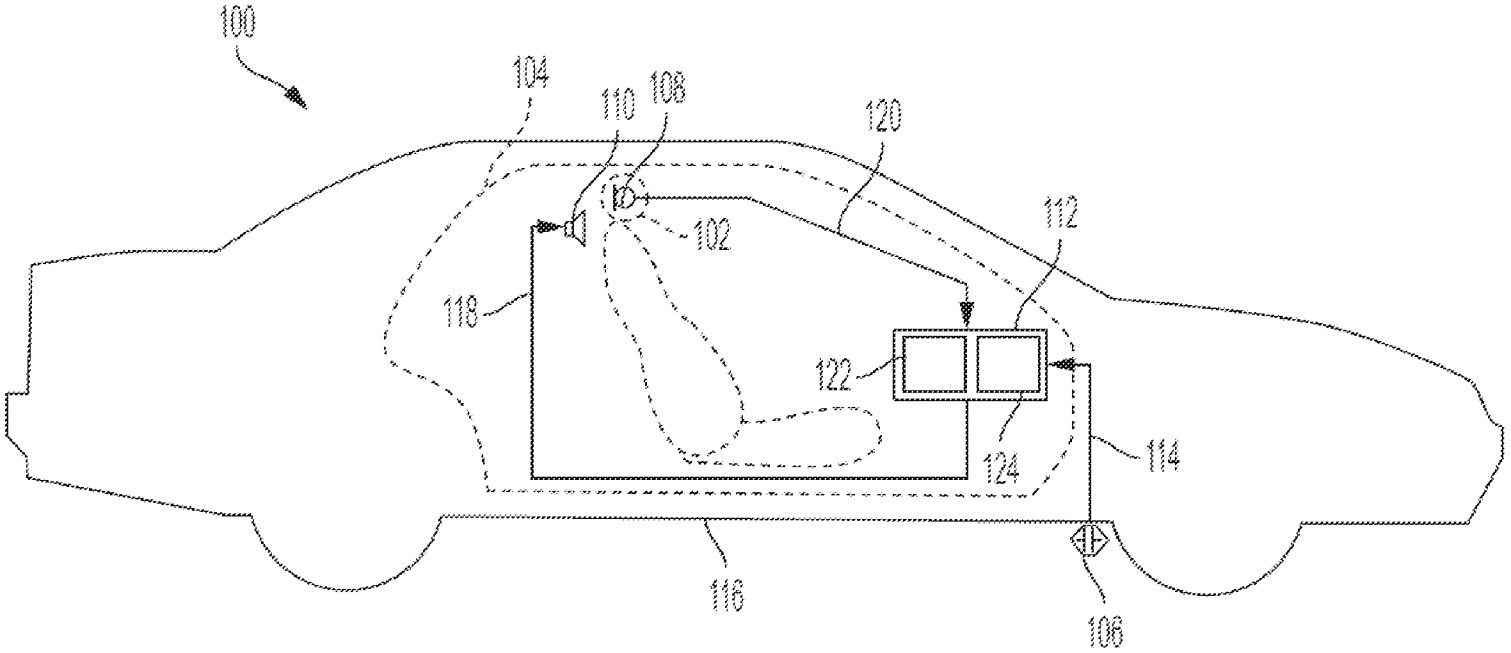
FIG. 1 depicts a schematic of an engine harmonic cancellation system implemented in a vehicle, according to an example.

FIG. 1 is a schematic view of an example engine harmonic cancellation system 100. Engine harmonic cancellation system 100 can be configured to destructively interfere with undesired engine harmonics in at least one cancellation zone 102 within a predefined volume 104 within a vehicle cabin. At a high level, an example of engine harmonic cancellation system 100 can include a reference sensor 106, an error sensor 108, a speaker 110, and a controller 112.

In an example, reference sensor 106 is configured to generate reference signal(s) 114 representative of the undesired sound, or a source of the undesired sound, within predefined volume 104. For example, as shown in FIG. 1, reference sensor 106 can be an accelerometer, or a plurality of accelerometers, positioned to detect the harmonics produced by an engine. In various examples, the reference sensor 106 can be positioned in the engine compartment, in the vehicle cabin, in the vehicle chassis, or any other location suitable for detecting the engine harmonics.

Speaker 110 can, for example, be one or more speakers distributed in discrete locations about the perimeter of the predefined volume 104. (Also referred to as actuators, a speaker is any device configured to receive an electrical signal and transduce it into an acoustic signal.) In an example, four or more speakers can be disposed within a vehicle cabin, each of the four speakers being located within a respective door of the vehicle and configured to project sound into the vehicle cabin. In alternate examples, speakers can be located within a headrest, or elsewhere in the vehicle cabin.

A harmonic cancellation signal 118 can be generated by controller 112 and provided to one or more speakers 110 in the predefined volume 104, which transduce the harmonic cancellation signal 118 to acoustic energy (i.e., sound waves). The acoustic energy produced as a result of harmonic cancellation signal 118 is approximately 180° (i.e., 180°±10°), out of phase with—and thus destructively interferes with—the undesired engine harmonics within the cancellation zone 102. The combination of sound waves generated from the harmonic cancellation signal 118 and the undesired harmonics in the predefined volume results in cancellation of the undesired harmonics, as perceived by a listener in a cancellation zone.

Because harmonic cancellation cannot be equal throughout the entire predefined volume, harmonic cancellation system 100 is configured to create the greatest harmonic cancellation within one or more predefined cancellation zones 102 within the predefined volume. The harmonic cancellation within the cancellation zones 102 can effect a reduction in undesired harmonics by approximately 3 dB or more (although in varying examples, different amounts of harmonic cancellation can occur). It should thus be understood that "cancellation" as used in this disclosure does not refer to total cancellation but rather than reduction of the undesired engine harmonics in the cancellation zone 102. In certain examples, the engine harmonics can be reduced to a target value. In other examples, the undesired engine harmonics can be reduced to the extent possible. The portion of the engine harmonics that remains uncancelled within the cancellation zone is referred to in this disclosure as "residual" or "uncancelled" harmonics.

Error sensor 108, disposed within the predefined volume, generates an error signal 120 representative of the residual harmonics resulting from the combination of the sound waves generated from the harmonic cancellation signal 118 and the undesired harmonics in the cancellation zone 102.

The error signal 120 is provided to controller 112 as feedback, error signal 120 representing residual harmonics uncanceled by the harmonic cancellation signal. Error sensors 108 can be, for example, at least one microphone mounted within a vehicle cabin (e.g., in the roof, headrests, pillars, or elsewhere within the cabin).

It should be noted that the cancellation zone(s) can be positioned remotely from error sensor 108. In this case, as will be discussed below, the error signal 120 can be filtered to represent an estimate of the residual noise in the cancellation zone(s). In either case, the error signal will be understood to represent residual undesired harmonics in the cancellation zone.

In an example, controller 112 can comprise a non-transitory storage medium 122 and processor 124. In an example, non-transitory storage medium 122 can store program code that, when executed by processor 124, implements the various filters, modules, components, and algorithms described below. For example, controller can comprise a SHARC floating-point DSP processor programmed as such. However, it should be understood that controller 112 can comprise any suitable processor, FPGA, ASIC, or other suitable hardware, which includes combinations of multiple processors/hardware.

Figure 2:
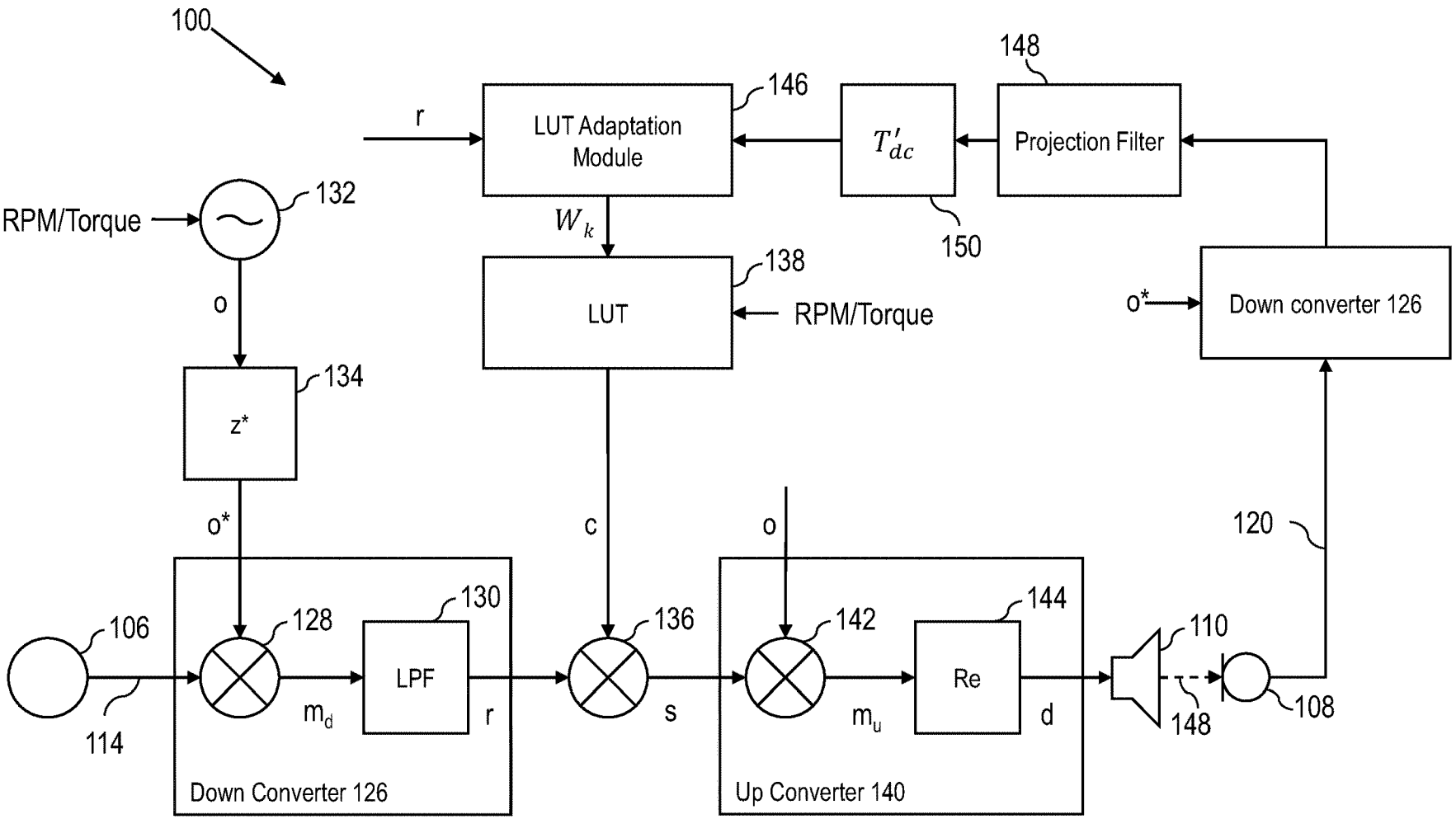
FIG. 2 depicts a block diagram of the engine harmonic cancellation system, according to an example.

FIG. 2 depicts a block diagram of engine harmonic cancellation system 100, including multiple components implemented by controller 112. As shown, the reference signal 114 can be received at down converter 126. A simplified expression of the harmonic content of reference signal 114 can be represented in the time domain as a complex exponential by the following equation:

$$A\cos(\omega_0 t + \varphi_r) = \frac{A}{2}(e^{j\omega_0 t+\varphi_r} + e^{-j\omega_0 t+\varphi_r}) \tag{1}$$

where A is the amplitude and $\omega_0$ the angular frequency and $\varphi_r$ is the phase of the harmonic content. Not represented in this equation is some modulation that will provide some bandwidth to the signal; however, this equation is useful for illustrative purposes. Furthermore, it should be understood, that the engine noise and the reference signal 114 will contain harmonics at multiple frequencies at a single point in time (i.e., at various harmonic numbers). The system and method described herein can be repeated for each such harmonic frequency. Indeed, it should be understood that the equations presented in this disclosure are presented in a simplified form for the purposes of illustration only and should not be deemed exclusive or limiting.

Down converter 126 converts the reference signal 114 to baseband. Down converter 126, in the example shown, comprises multiplier 128 and lowpass filter 130. Multiplier 128 multiplies the reference signal 114 by a value to shift the reference signal 114 frequency $\omega_0$ down to baseband. More specifically, multiplier 128 receives the complex conjugate o* of the output o of a complex-valued oscillator 132, producing an output that can be mathematically modeled as:

$$e^{j(\omega_0 t+\theta)} \tag{2}$$

where $\omega_0$ is again the angular frequency of the harmonic content of the reference signal 114 and θ represents a phase introduced by the complex-valued oscillator (this phase will be removed later at up convert). The angular frequency $\omega_0$ of the oscillator signal o is selected according to information about the state of the engine and vehicle. For example, the revolutions per minute (RPM) of the vehicle engine is related to the harmonic content of the engine noise. For example, generally the harmonic content increases in frequency as the RPM increase. Thus, the RPM of the vehicle engine can be used to select the target harmonic frequency $\omega_0$. In addition, other factors, such as the torque produced by the engine can modify which harmonic frequencies are produced at a particular RPM. For example, an engine that is revved at idle will produce different harmonic frequencies to an engine that is driven under load, although the engine reaches the same RPM in both cases. Thus, torque can be used to determine the harmonic order, and, accordingly, the appropriate target angular frequency $\omega_0$. (A look-up table can be employed to select the appropriate angular frequency $\omega_0$ of oscillator signal o according to the state of the engine or vehicle, e.g., RPM and/or torque, etc.)

The complex conjugate of the oscillator signal o, is found by the complex conjugate module 134, and can be modeled as follows:

$$e^{-j(\omega_0 t+\theta)} \tag{3}$$

The complex conjugate o* is input to the multiplier 128, which outputs the down converter signal $m_d$. Multiplying the reference signal 114 by the complex conjugate o* of the oscillator signal o effectively shifts the $\omega_0$ term of the reference signal 114 down to baseband and the $-\omega_0$ term down to $-2j\omega_0$ such that the down converted reference signal $m_d$ can be mathematically represented as follows:

$$\frac{A}{2}e^{-j(\theta+\varphi_r)} + \frac{A}{2}e^{-2j(\omega_0 t-\theta+\varphi_r)} \tag{4}$$

The down converted reference signal $m_d$ is then input to a low pass filter 130, the cut off frequency of which is selected to filter nearly everything except the $-j\theta$ term, including filtering the $-2j\omega_0$ term. As a result, the baseband reference signal r output from the lowpass filter 130 (and from down converter 126) is a baseband signal having an amplitude A of the target harmonic content of the reference signal 114 and a phase θ equal to the phase difference between the reference signal 114 and the oscillator signal o and can be represented as:

$$\frac{A}{2}e^{-j(\theta+\varphi_r)} \tag{5}$$

Thus baseband reference signal r can be thought of as a DC signal having a magnitude A and a phase which is the sum of the phase $\varphi_r$ of the reference signal 114 and the phase θ of the complex-valued oscillator 132.

Because this signal is mixed down to baseband, it is represented as not having a frequency component and thus is represented as a DC phasor value having only a magnitude and phase. It should, however, be understood that the baseband reference signal r can include a nominal frequency component, such as 5 Hz or 10 Hz (depending on the cutoff of LPF 130) to capture fluctuations in the reference signal and rapid shifts in RPM. To further account for this, the cut off frequency of low pass filter 130 can depend on parameters such as the change in RPM from sample to sample. In other words, the cut off frequency can be made higher for large changes in RPM and smaller for low changes.

Down converter 126 thus performs a dual function of isolating the harmonic content of the accelerometer signal and resulting in a value representative of the harmonic content at DC, which changes, comparatively, very slowly.

Thus, the remaining portions of the engine harmonic cancellation system 100 (e.g., multiplier 136, LUT 138, up converter 140, etc.) can accordingly be clocked at a value lower than other functions, such as a road-noise cancellation system if one is concurrently employed, without aliasing. This increases the efficiency of operating the engine harmonic cancellation system 100 (e.g., through reduced MIPS) without sacrificing performance. In addition, by down converting and operating in the time domain, rather than in the frequency domain, the harmonic frequencies can be operated on without continuity issues that would arise from doing similar operations in the frequency domain.

The output baseband reference signal r of down converter 126 is mixed at multiplier 136 with the baseband output of look up table (LUT) 138. The baseband output of LUT 138 is configured such that, when mixed with baseband reference signal r and mixed to passband at up converter 140, the resulting signal is a harmonic cancellation signal that when transduced by speaker 110 an acoustic signal that cancels the harmonic content of the engine noise at cancellation zone 102 within the vehicle cabin (e.g., at a passenger's ears).

The LUT 138 can be employed in this example, rather than an FIR filter, because the target harmonic is narrowband, rather than broadband such as might exist in an RNC context. In addition, the use of a LUT further provides greater flexibility and shorter times responding to rapid changes in engine harmonic, as might occur when the engine is revved, because retrieving values from the LUT is generally much faster than adapting the coefficients of a filter. Further, the use of a LUT in this context is preferred over an FIR filter because the LUT will not suffer from the same causality problems in translating a phase value as an FIR filter might.

The passband harmonic cancellation signal d output from up converter 140 (as will be described below) and input to speaker 110 can be modeled as:

$$B\cos(\omega_0 t+\varphi_h+\varphi_r) \tag{6}$$

where phase $\varphi_h$ is a necessary phase change to the phase $\varphi_r$ of reference signal 114 in order to cancel the engine harmonic in the cancellation zone and is informed by the transfer function from the speaker 110 to the cancellation zone.

The output of the LUT 138 can thus be modeled as $$\frac{2B}{A}e^{j\varphi_h} \tag{7}$$

such that mixing the baseband signal c of LUT 138 with the output of the downconverter results in a baseband harmonic cancellation signal s, which can be represented as $$Be^{j(\varphi_r+\varphi_h-\theta)} \tag{8}$$

thus, in this example, introducing the amplitude B and a phase equal to sum of the phase $\varphi_r$ of the reference signal, the phase change $\varphi_h$ introduced by LUT 138 (and needed to cancel the target harmonic in the cancellation zone) and the phase $-\theta$ of the complex-valued oscillator 132.

Mixing this signal with the oscillator signal o at multiplier 142 of up converter 140 yields $$Be^{j\omega 0+\varphi_h+\varphi_r} \tag{9}$$

the real portion of which, as found by real value module 144, forms harmonic cancellation signal d. LUT 138 thus functions to translate the output of down converter 126 to an amplitude and phase value that, when mixed to passband at up converter 140, renders the harmonic cancellation signal d. Thus, mixing the baseband harmonic cancellation signal s with the output o of the complex-valued oscillator 132 shifts the baseband reference signal to the angular frequency $\omega_0$ of the target harmonic and removes the phase shift $\theta$ initially introduced by mixing the complex conjugate signal o*, yielding only the phase of $\varphi_r$ of the reference signal 114 and the phase shift $\varphi_h$ of LUT 138.

Like complex-valued oscillator 132, LUT 138 receives as an input RPM and/or torque, or any other suitable input related to the state of the engine or vehicle from which the angular frequency $\omega_0$ can be determined. (Alternatively, LUT 138 can receive the angular frequency $\omega_0$ from complex-valued oscillator or any other process from which the angular frequency $\omega_0$ is determined.) From this input, LUT 138 retrieves the appropriate amplitude B/A and phase value $\varphi_h$ for baseband signal c. LUT 138 thus effectively associates an output baseband signal with the frequency of a target harmonic. When the harmonic of a particular frequency is detected at reference sensor 106, the appropriate baseband signal is retrieved and output to the multiplier 136. The phase $\varphi_h$ of baseband signal c and ultimately of the harmonic cancellation signal d will be functions of frequency and of the transfer function from the actuator 110 to the cancellation zone. The transfer function from the actuator 110 to the cancellation zone should typically remain constant during runtime, although changes to it will generally be captured in the adaptation of LUT 138, as discussed below. LUT 138 maintains the amplitude B/A of the baseband signal c at a constant ratio, as determined by the magnitude A of the reference signal 114 (and down converter output c) and the desired magnitude B of the harmonic cancellation signal d.

Acceleration or deceleration of the vehicle can alter the amplitude and phase of the harmonics in the cancellation zone, and, accordingly, the necessary values of amplitude B and phase $\varphi_h$ of the harmonic cancellation signal in order to cancel the harmonics in the cancellation zone. To account for this, the torque value (or any other value representative of acceleration or deceleration of the vehicle), can be used to select between LUTs, one LUT being used for acceleration and the other being used deceleration. For example, for a positive torque value indicative of acceleration, LUT 138 can implement one LUT storing an association between harmonic frequency $\omega_0$ values and an amplitude and phase shift (e.g., $B_1$ and $\varphi_{h1}$) of baseband signal c; whereas, for a negative torque value indicative of deceleration, LUT 138 can implement a second LUT storing an association between harmonic frequency $\omega_0$ and a different amplitude and phase shift (e.g., $B_2$ and $\varphi_{h2}$) of baseband signal c. Alternatively, LUT 138 can output a value for the amplitude and phase shift of baseband signal c that is interpolated between the two LUTs, depending on the torque value received. However, in instances where multiple accelerometers (or other reference sensors) are employed, the ability to receive reference signals across multiple axes generally obviates the need for torque as an input and multiple LUTs.

The error signal 120 output from error sensor 108 is used by LUT adaptation module to adjust the LUT 138 to better cancel the harmonic content in the cancellation zone (i.e., to adjust the values of B and $\varphi_h$). In an example, LUT adaptation module 146 can update the table value $W_k$ at frequency value k and at time n+1 (i.e., the amplitude value and phase value of the output signal c for a given frequency k, such as at angular frequency $\omega_0$) according to the following update equation:

$$W_k[n+1] = W_k[n] - \mu_k \frac{R^H \times M}{R^H \times R} \tag{10}$$

where R is the frequency-domain reference signal r, M is the downconverted frequency value of the error signal 120 as seen at the actuator 110, and $\mu_k$ is the step size, which determines the adaptation rate. Because the harmonics at one angular frequency are canceled, only values for that frequency (e.g., angular frequency $\omega_0$) need to be updated, further improving the efficiency of harmonic cancellation system 100. Because LUT 138 provides a baseband output signal, the error signal 120 is also downconverted prior to being input to LUT adaptation module 146 by down converter 126.

In addition, error sensor 108, as described above, is positioned to detect a magnitude of the residual harmonics within the vehicle cabin. In one example, error sensor 108 is positioned within cancellation zone 102 (e.g., in a microphone worn in a headset at a user's ears). However, it can often be difficult to position microphone 120 in the cancellation zone 102. In these cases, the error signal e will not accurately represent the error of the harmonic cancellation signal d, as error sensor 108 is not positioned in the cancellation zone and the magnitude of the engine harmonic varies in space. As a result, the error signal is indicative of the error at the error sensor 108, but not at cancellation zone 102. This will result in undesirably updating LUT 138 to cancel the harmonic at the position of error sensor 108 instead of at cancellation zone 102.

To account for this, the error signal 120 can be filtered to estimate the residual harmonic in cancellation zone 102. For example, as shown in FIG. 2, projection filter 148 can estimate the residual harmonic at the cancellation zone. In various examples, projection filter 148 can include a first filter that is based on an estimate of an acoustic relationship between the location of error sensor 108. This filter receives the error signal 120 (converted to baseband) and "projects" (i.e., estimates) the value of the error signal at the cancellation zone. Projection filter 148 can further include a second filter that estimates the relationship between the speaker 110 and the cancellation zone. The second filter receives the harmonic cancellation signal d and estimates the value of the harmonic cancellation signal d at the cancellation zone. By summing the outputs of the first and second filter, the error at the cancellation zone (converted to baseband) can be estimated. Such a projection filter is described in more detail in U.S. Pat. No. 10,629,183 issued on Apr. 21, 2020, titled "Systems and Methods for Noise-Cancellation using Microphone Projection," the entirety of which is incorporated by reference for all purposes. It is, however, contemplated, that other projection filters could be employed; indeed, any projection filter suitable for estimating the residual engine harmonic at the cancellation zone can be used.

The output of projection filter 148 in the feedback loop to LUT adaptation module 146 is also input to the $T'_{dc}$ filter 150, which implements a transpose (time-flipped version) of the transfer function between the driver and the cancellation zone, effectively backing out the time delay between the speaker 110 and the cancellation zone. In an alternative example, rather than $T'_{dc}$ filter 150, a filter implementing the pseudo-inverse could be employed in the MIMO example (i.e., multiple input reference signals and multiple harmonic cancellation signals output to multiple transducers). In either case, the variable M, described above in connection with the Eq. 10 represents the output of the feedback loop to LUT Adaptation Module 146, which is a downconverted estimate of the residual engine harmonic at the cancellation zone with the delay from the cancellation zone to the speaker removed.

In one example, LUT adaptation module 146 and the feedback loop to it can be omitted, with the LUT 138 operating without changing the values of the look up table during runtime. This example, however, will fail to account for changes to the transfer function between the speaker 110 and the cancellation zone or to otherwise mitigate error from residual engine harmonics over time.

Figure 3:
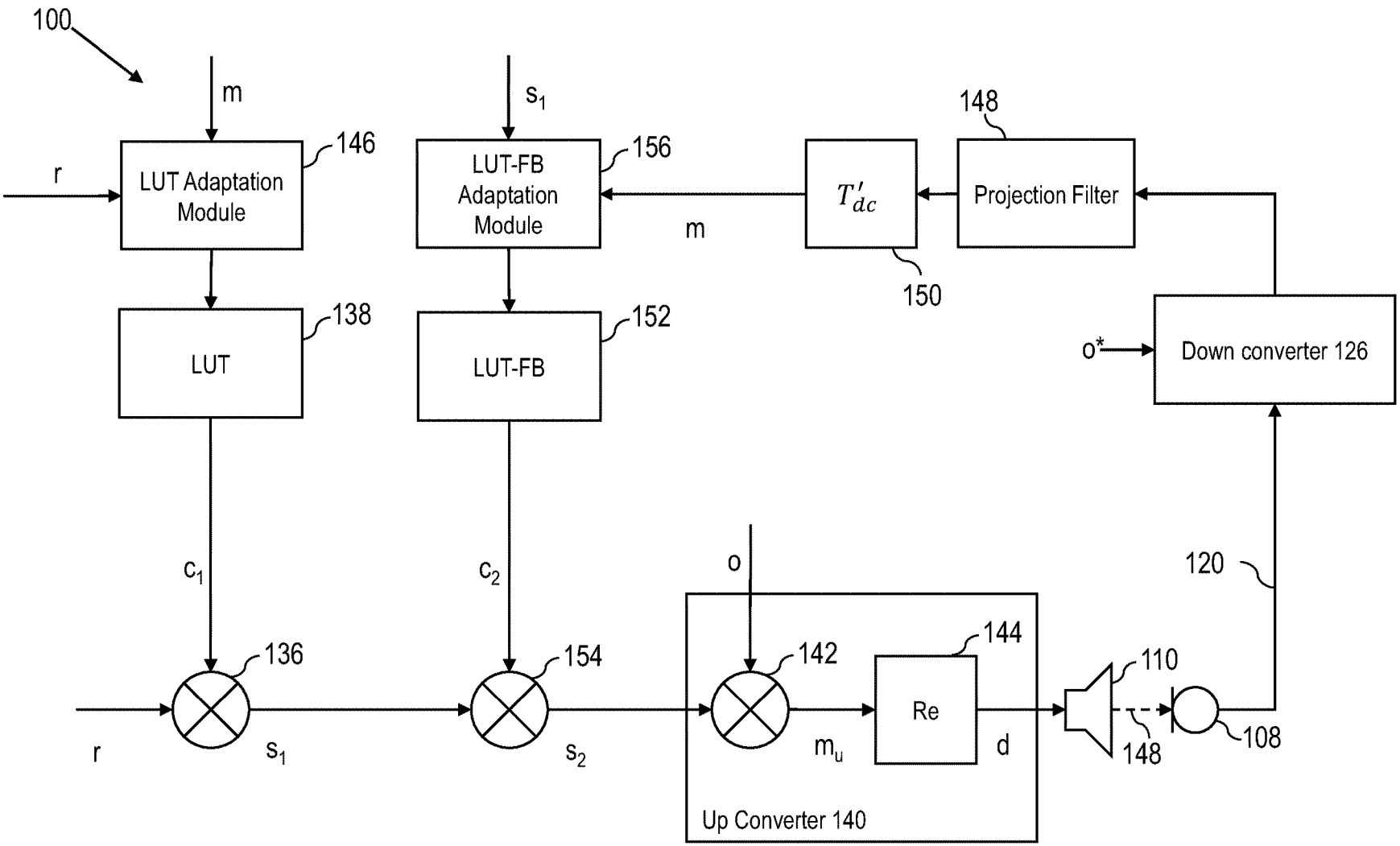
FIG. 3 depicts a block diagram of the engine harmonic cancellation system, according to an example.

As described above, the LUT 138 will adapt to changes occurring in the transfer function between the speaker 110 and the cancellation zone. However, it will not account for rapid changes, such as a passenger opening a window in the vehicle. To account for such rapid changes, FIG. 3 depicts an alternative example of engine harmonic cancellation system 100, in which a second LUT, shown as LUT-FB 152, is employed. (Although accelerometer 106, down converter 126, oscillator 132, and complex conjugate module 134 have been excluded from the view of FIG. 3, it should be understood that engine harmonic cancellation system 100 in FIG. 3 is identical to harmonic cancellation system 100 except for the inclusion of LUT-FB 152, multiplier 154, and LUT-FB adaptation module 156.)

As shown in FIG. 3, the output $s_1$ of multiplier 136 is input to multiplier 154, which multiplies output $s_1$ with the output of with the output $c_2$ of LUT-FB 152. LUT-FB 152 is updated by LUT-FB Adaptation Module 156 according to the following update equation:

$$W_k[n+1] = 1 + \left(W_k[n] - 1 - \mu_k \frac{R \times M}{R^H \times R}\right)\lambda \tag{11}$$

where $\lambda$ is a forgetting factor. Likewise, the update equation for LUT 138 is modified as follows to include forgetting factor A:

$$W_k = \left(W_k - \mu_k \frac{R \times M}{R^H \times R}\right)\lambda \tag{12}$$

As a result, the update to LUT 138 will trend toward zero, but the update equation to LUT-FB 152 will trend toward one. Thus, rapid changes to the transfer function between speaker 110 and the cancellation zone will be captured by LUT-FB 152 while LUT 138 is still updating. Longer term changes to the transfer function will be captured by LUT 138, as LUT-FB 152 trends toward a value of one (thus not impacting the output). Thus, in this example, the combination of LUT 138 and LUT-FB 152 create the baseband harmonic cancellation signal $s_2$. It should be understood that the order of LUT 138 and LUT-FB 152 can be switched without changing the function of harmonic cancellation system 100 (e.g., the output $c_2$ of LUT-FB 152 can be mixed with the baseband reference signal r first without changing the operation of harmonic cancellation system 100).

Figure 4A:
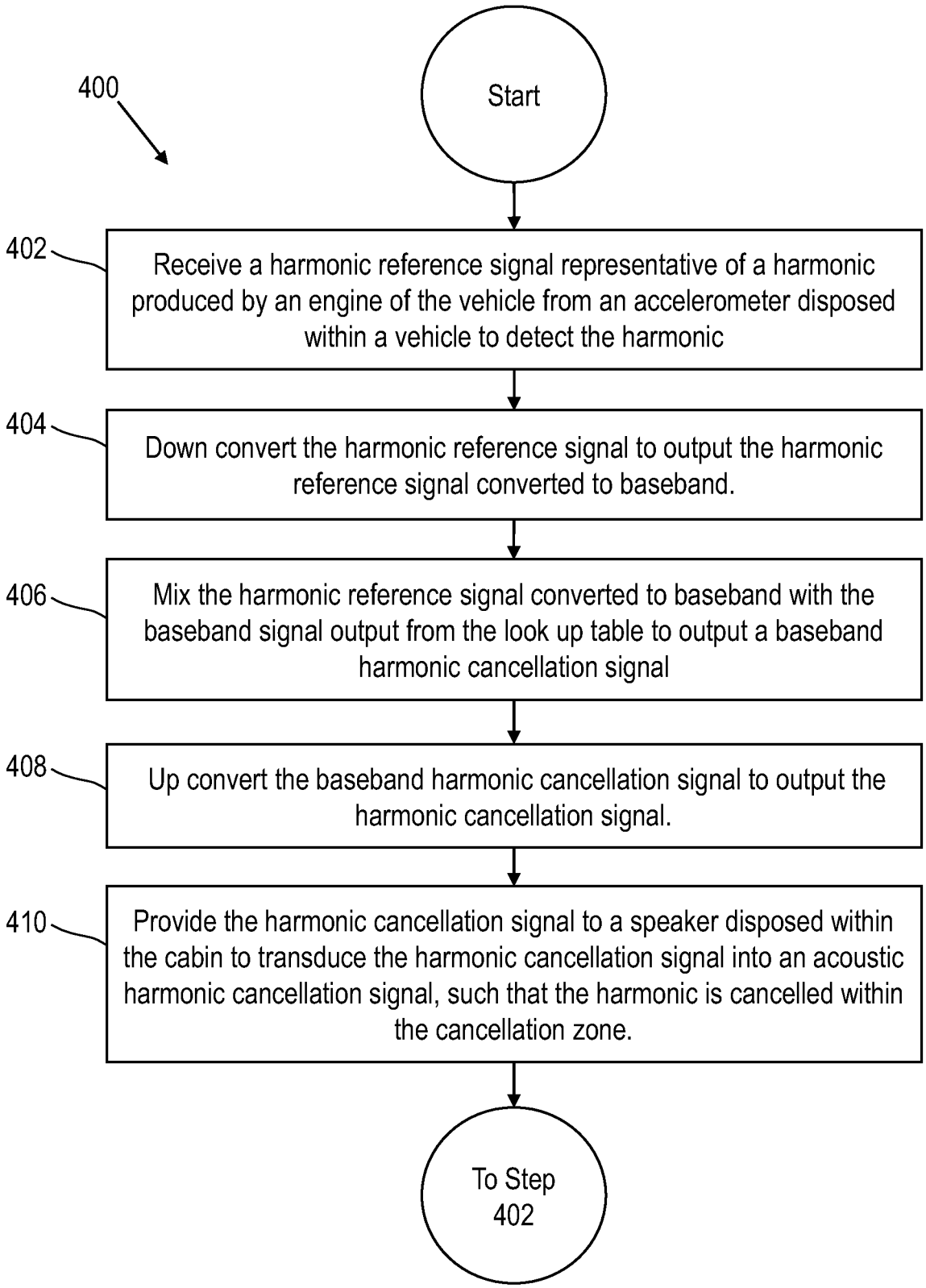
FIG. 4A depicts a method for cancelling engine harmonics, according to an example.

While the example of FIGS. 1-3 has been provided for a single reference sensor 106, speaker 110, error sensor 108, and harmonic cancellation zone 102, it should be understood that, in application, multiple of such sensors, speakers, and cancellation zones are typically employed or created. Generally, the number of look up tables will be equal to the number of reference sensors (M) multiplied by the number of speakers (N). Each reference sensor is down converted and mixed N times, and each speaker signal is then obtained as a summation of M signals. This can be repeated for each desired cancellation zone in the vehicle cabin. It should be also understood that multiple reference sensors, error sensors, speakers, and harmonic cancellation zones can be employed or created in the method described below in connection with FIGS. 4A-4C.

Harmonic cancellation system 100 can be employed in addition to a road noise cancellation system. For example, the output of a road noise cancellation system can be summed with the output of harmonic cancellation system 100 at each speaker in order to both cancel road noise and engine harmonics in the cancellation zone(s) of the vehicle cabin 104.

FIG. 4 depicts a flowchart of a method 400 for estimating cancelling an engine harmonic in a vehicle cabin. As described above, this method can be implemented by a computing device, such as controller 112. Generally, the steps of the computer-implemented method are stored in a non-transitory storage medium and are executed by the processor of the computing device. However, at least some of the steps can be carried out in hardware rather than by software.

At step 402, a harmonic reference signal representative of a harmonic produced by an engine of the vehicle is received from a reference sensor disposed within a vehicle to detect the harmonic. Reference sensor can be, for example, reference sensor 106, which can be an accelerometer, although any other sensor suitable for detecting the harmonics produced by the engine can be used. The reference sensor can be disposed in a position suitable for detection of the engine harmonics, such as the engine compartment, the vehicle cabin, or elsewhere on the vehicle chassis.

At step 404, the harmonic reference signal is down converted to output the harmonic reference signal converted to baseband. The harmonic reference signal, output from the reference sensor, can be down converted by a down converter such as down converter 126, which includes a multiplier and a low pass filter. The multiplier receives the complex conjugate output of a complex-valued oscillator, such as oscillator 132. The complex-valued oscillator outputs a signal that has a frequency equal to the frequency of the target harmonic, such that the target harmonic of the harmonic reference signal is mixed down to baseband when the harmonic reference signal is multiplied by the complex conjugate of the oscillator at the multiplier. The frequency of the oscillator is selected, for example, according the RPMs of the vehicle engine, which are typically correlated to the frequency of the target harmonic. Although, in alternative examples, other useful metrics related to the state of the engine or the vehicle, such as torque, can be used to determine the appropriate frequency of the target harmonic. Additional potential inputs can include harmonic number to distinguish the particular harmonic to be targeted from the other harmonics produced by the engine at any point in time.

The low pass filter functions to exclude nearly everything except the baseband harmonic reference signal. In an example, the low pass filter can permit a small bandwidth (e.g., 5-10 Hz) of the baseband harmonic reference signal to account for fluctuations in the harmonic reference signal and bandwidth that results from rapidly changing RPMs of the engine. In an example, the cutoff frequency can be changed in accordance with the change in RPMs from sample to sample (i.e., greater changes results in a higher cut off frequency).

At step 406, the harmonic reference signal converted to baseband is mixed with the baseband signal output from the look up table to output a baseband harmonic cancellation signal. In an example, the baseband harmonic reference signal is mixed at a multiplier such as multiplier 136 with the output of a LUT such as LUT 138. The LUT is configured to output a baseband signal that, when mixed with the baseband harmonic reference signal, translates the phase and amplitude of the baseband harmonic reference to a value that, when up converted to passband and then transduced by a speaker in the vehicle cabin, will cancel the harmonics in the cancellation zone (this is represented in, for example, Eqs. (7) and (8) above). The LUT effectively associates an output baseband signal with the frequency of a target harmonic. When the harmonic of a particular frequency is detected at reference sensor, the appropriate baseband signal is retrieved and output to the multiplier. Like the complex-valued oscillator, the LUT relies on metrics related to the state of the engine or the vehicle, such as RPM, torque, harmonic number, etc. to determine the appropriate value from the LUT to be mixed with the baseband harmonic reference signal. In an alternative example, the LUT can simply retrieve the values associated with the frequency determined for the complex-valued oscillator.

At step 408, the baseband harmonic cancellation signal is up converted to passband to output the harmonic cancellation signal. This can be performed by an up converter such as up converter 140, which includes a multiplier that receives the output of the complex-valued oscillator to return the signal to a signal having the frequency of the target harmonic frequency (but a phase and amplitude being determined by the mixing of the baseband harmonic reference signal with the output of the LUT). This step also involves taking the real portion, such as with real value module 144, of the passband harmonic cancellation signal to put the harmonic cancellation signal in position to be transduced by speaker 110.

At step 410, the harmonic cancellation signal is provided to a speaker disposed within the cabin to transduce the harmonic cancellation signal into an acoustic harmonic cancellation signal, such that the harmonic is cancelled within the cancellation zone. For example, the harmonic cancellation signal can be provided to speaker 110 which is disposed within the vehicle cabin to produce the acoustic harmonic signal in a manner that will cancel the target harmonic in the cancellation zone within the vehicle cabin.

Following this step, the method can return to step 402 to receive a new sample from the reference sensor, thus operating in a loop to continually track and cancel the engine harmonics during runtime.

Figure 4B:
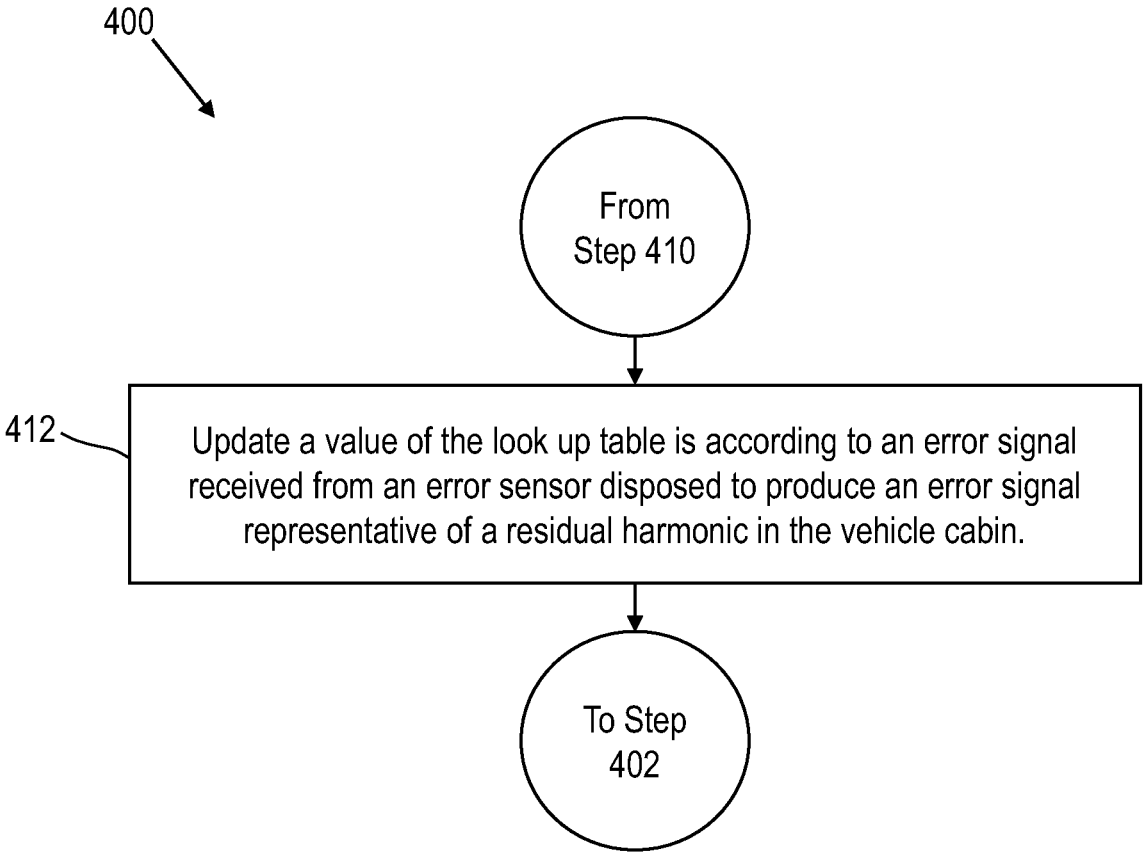
FIG. 4B depicts a method for cancelling engine harmonics, according to an example.
Figure 4C:
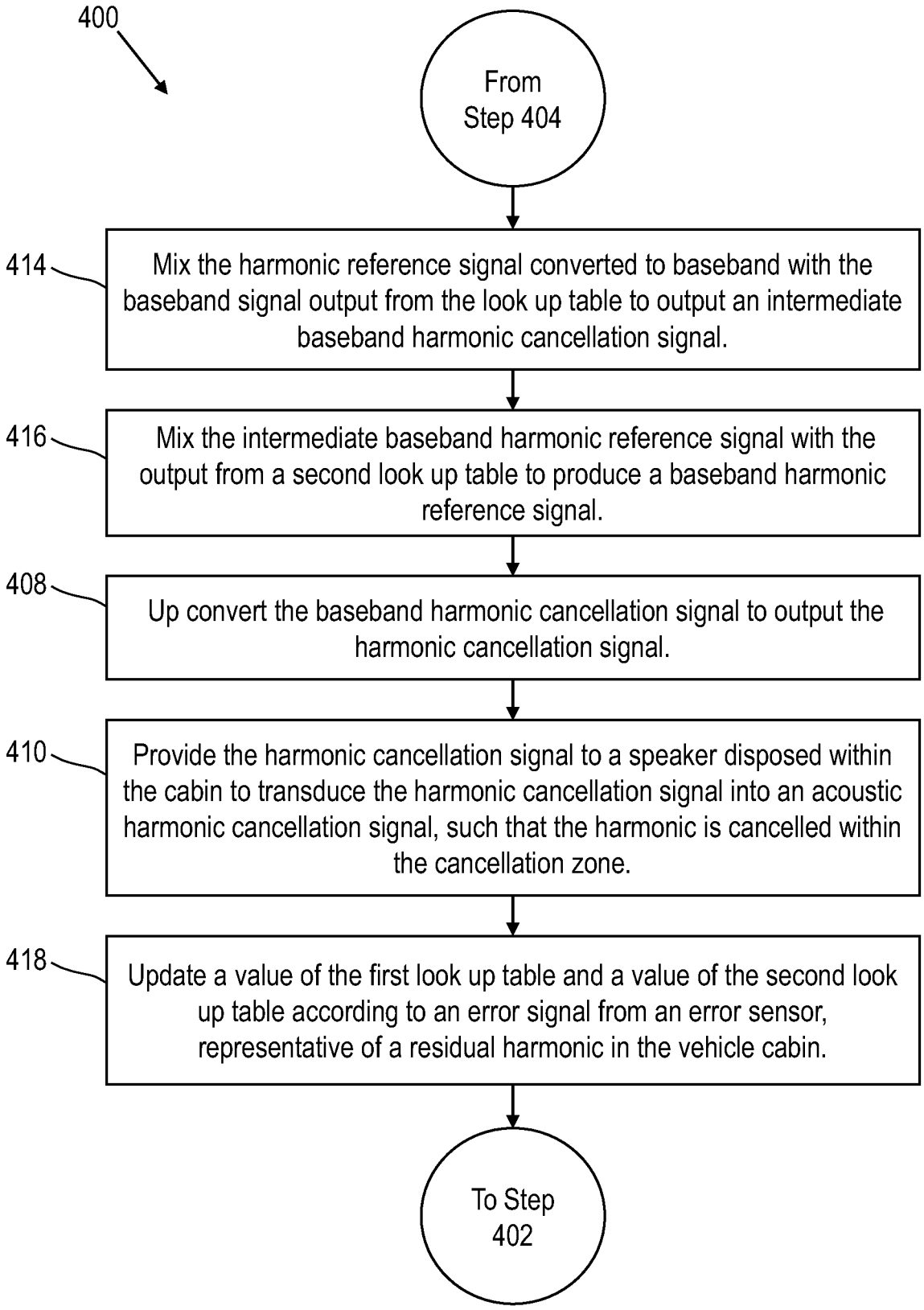
FIG. 4C depicts a method for cancelling engine harmonics, according to an example.

In addition, at step 412, shown in FIG. 4B, a value of the look up table is updated according to an error signal received from an error sensor disposed to produce an error signal representative of a residual harmonic in the vehicle cabin. This signal can be down converted so that the LUT is appropriately updated to produce the baseband signal to be mixed with the baseband harmonic reference signal. Further, error signal from the error sensor can be filtered, such as with projection filter 148, which estimates the value of the error sensor within the cancellation zone, in the instance in which the error sensor is positioned outside the cancellation zone. Further, the error sensor signal can be input to a filter, such as filter 150, which is the transpose of the transfer function between the speaker and the cancellation zone, in order to back out of the delay between the speaker and the cancellation zone. The LUT can be updated according to an update equation such as Eq. (10), which also relies on the baseband harmonic reference signal; although, it is contemplated that other update equations can be used. Generally, the error signal is used to update the baseband signal that is stored in association with the frequency of the target harmonic, rather than updating each value of the LUT, in order to increase efficiency.

FIG. 5C depicts a set of steps (414 and 416) that are alternative to step 406 as well as an additional step 418. At step 414, the harmonic reference signal converted to baseband is mixed with the baseband signal output from the look up table to output an intermediate baseband harmonic cancellation signal. This basically follows step 404, except that the output is not the baseband harmonic cancellation signal because it is mixed again at step 416 to arrive at the baseband harmonic cancellation signal.

At step 416, the intermediate signal is mixed with the output of a second look up table to output the baseband harmonic cancellation signal. The second look up table can be, for example, be LUT-FB 152. The second look up table is employed because the look up tables are updated according to different forgetting factors as described below at step 418. The baseband harmonic cancellation signal is provided, at steps 406 and 408, to an up converter and a speaker to be transduced into an acoustic harmonic cancellation signal.

At step 418, a value of the first look up table and a value of the second look up table are updated according to an error signal from an error sensor, representative of a residual harmonic in the vehicle cabin. This generally follows the updating of step 412, described above, (including projecting, down converting, and backing out the delay of the error signal) except that that update equations are amended, as shown in an example in Eqs. (11) and (12) to include a forgetting factor and such that the look up table will trend toward zero over time, while the second look up table will trend toward one. As a result, the first look up table will respond slower to changes in the transfer function from the speaker to the cancellation, while the second look up table responds quickly to such changes, so that these changes do not result in pronounced harmonics while the look up table is updating. It should be understood that the orders of the look up table and the second look up table can be switched, so that the second look up table occurs first in the processing chain and outputs the baseband signal that results in the intermediate harmonic cancellation signal.

As mentioned above, the mathematical equations provided in this disclosure are simplified for the purposes of illustrating the principles of the inventive aspects only and should not be deemed exclusive or limiting in any way. Furthermore, variations in the mathematical equations are contemplated and are within the spirit and scope of this disclosure.

Regarding the use of symbols herein, a capital letter, e.g., H, generally represents a term, signal, or quantity in the frequency or spectral domain, and a lowercase letter, e.g., h, generally represents a term, signal, or quantity in the time domain. Relation between time and frequency domain is generally well known, and is described at least under the realm of Fourier mathematics or analysis, and is accordingly not presented herein. Additionally, signals, transfer functions, or other terms or quantities represented by symbols herein may be operated, considered, or analyzed in analog or discrete form. In the case of time domain terms or quantities, the analog time index, e.g., t, and/or discrete sample index, e.g., n, may be interchanged or omitted in various cases. Likewise, in the frequency domain, analog frequency indexes, e.g, f, and discrete frequency indexes, e.g., k, are omitted in most cases. Further, relationships and calculations disclosed herein may generally exist or be carried out in either time or frequency domains, and either analog or discrete domains, as will be understood by one of skill in the art. Accordingly, various examples to illustrate every possible variation in time or frequency domains, and analog or discrete domains, are not presented herein.

The functionality described herein, or portions thereof, and its various modifications (hereinafter "the functions") can be implemented, at least in part, via computer program product, e.g., a computer program tangibly embodied in an information carrier, such as one or more non-transitory machine-readable media or storage device, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing all or part of the functions can be performed by one or more programmable processors executing one or more computer programs to perform the functions of the calibration process. All or part of the functions can be implemented as, special purpose logic circuitry, e.g., an FPGA and/or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. Components of a computer include a processor for executing instructions and one or more memory devices for storing instructions and data.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the inventive scope of the present disclosure.

What is claimed is:

1. An engine harmonic cancellation system, comprising:

an accelerometer disposed within a vehicle to detect a harmonic produced by an engine of the vehicle and to produce a harmonic reference signal representative of the harmonic;

a controller configured to produce a harmonic cancellation signal that, when transduced into an acoustic signal, cancels the harmonic within at least one cancellation zone within a cabin of the vehicle, wherein the harmonic cancellation signal is based, at least in part, on mixing the harmonic reference signal converted to baseband with a baseband signal output from a look up table, wherein the controller is further configured to up convert a baseband harmonic cancellation signal to the harmonic cancellation signal; and a speaker disposed within the cabin and configured to receive the harmonic cancellation signal and to transduce the harmonic cancellation signal into an acoustic harmonic cancellation signal, such that the harmonic is cancelled within the cancellation zone.

2. The system of claim 1, wherein the controller implements a down converter configured to receive the harmonic reference signal and to output the harmonic reference signal converted to baseband.

3. The system of claim 2, wherein the baseband signal has an amplitude and a phase, wherein the amplitude is selected to be a constant ratio with an amplitude of the harmonic reference signal converted to baseband, wherein the phase is equal to a phase of the harmonic cancellation signal when summed with a phase of the harmonic reference signal converted to baseband.

4. The system of claim 3, wherein the controller implements a multiplier, wherein the multiplier mixes the harmonic reference signal converted to baseband with the baseband signal output from the look up table to output the baseband harmonic cancellation signal.

5. The system of claim 1, further comprising an error sensor disposed to produce an error signal representative of a residual harmonic in the cabin of the vehicle, wherein a value of the look up table is updated according to the error signal.

6. The system of claim 5, wherein the error sensor is disposed outside of the cancellation zone, wherein the controller is further configured to implement a projection filter configured to estimate a value of the residual harmonic within the cancellation zone.

7. The system of claim 1, wherein the controller implements a multiplier, wherein the multiplier mixes the harmonic reference signal converted to baseband with the baseband signal output from the look up table to output an intermediate baseband harmonic cancellation signal, wherein the controller further implements a second look up table and a second multiplier, wherein the second multiplier mixes the intermediate baseband harmonic cancellation signal with an output from the second look up table to produce the baseband harmonic cancellation signal.

8. The system of claim 7, wherein a value of the look up table and a value of the second look up table is updated according to an error signal from an error sensor, representative of a residual harmonic in the vehicle cabin, wherein the second look up table is updated to adapt faster to changes in a transfer function between the speaker and the cancellation zone than the look up table.

9. The system of claim 7, wherein a value of the look up table and a value of the second look up table is updated according to an error signal from an error sensor, representative of a residual harmonic in the vehicle cabin, wherein the look up table is updated to adapt faster to changes in a transfer function between the speaker and the cancellation zone than the second look up table.

10. The system of claim 1, wherein the look up table is configured to select a first value at a first torque value and a second value at a second torque value.

11. A method for cancelling engine harmonics in a vehicle cabin, comprising the steps of:

receiving a harmonic reference signal representative of a harmonic produced by an engine of the vehicle from an accelerometer disposed within a vehicle to detect the harmonic;

producing a harmonic cancellation signal that, when transduced into an acoustic signal, cancels the harmonic within at least one cancellation zone within a cabin of the vehicle, wherein the harmonic cancellation signal is based, at least in part, on mixing the harmonic reference signal converted to baseband with a baseband signal output from a look up table, wherein the controller is further configured to up convert a baseband harmonic cancellation signal to the harmonic cancellation signal; and providing the harmonic cancellation signal to a speaker disposed within the cabin and configured to receive the harmonic cancellation signal to transduce the harmonic cancellation signal into an acoustic harmonic cancellation signal, such that the harmonic is cancelled within the cancellation zone.

12. The method of claim 11, further comprising the step of down converting the harmonic reference signal to output the harmonic reference signal converted to baseband.

13. The method of claim 12, wherein the baseband signal has an amplitude and a phase, wherein the amplitude is selected to be a constant ratio with an amplitude of the harmonic reference signal converted to baseband, wherein the phase is equal to a phase of the harmonic cancellation signal when summed with a phase of the harmonic reference signal converted to baseband.

14. The method of claim 13, further comprises the step of:

mixing the harmonic reference signal converted to baseband with the baseband signal output from the look up table to output the baseband harmonic cancellation signal.

15. The method of claim 11, further comprising the step of updating a value of the look up table is according to an error signal received from an error sensor disposed to produce an error signal representative of a residual harmonic in the vehicle cabin.

16. The method of claim 15, further comprising the step of estimating a value of the residual harmonic within the cancellation zone, wherein the error sensor is disposed outside of the cancellation zone.

17. The method of claim 11, further comprising the step of:

mixing the harmonic reference signal converted to baseband with the baseband signal output from the look up table to output an intermediate baseband harmonic cancellation signal, mixing the intermediate baseband harmonic cancellation signal with the output from a second look up table to produce the baseband harmonic cancellation signal.

18. The method of claim 17, further comprising the step of updating a value of the look up table and a value of the second look up table according to an error signal from an error sensor, representative of a residual harmonic in the vehicle cabin, wherein the second look up table is updated to adapt faster to changes in a transfer function between the speaker and the cancellation zone than the look up table.

19. The method of claim 17, further comprising the step of updating a value of the look up table and a value of the second look up table according to an error signal from an error sensor, representative of a residual harmonic in the vehicle cabin, wherein the look up table is updated to adapt faster to changes in a transfer function between the speaker and the cancellation zone than the second look up table.

20. The method of claim 11, wherein the look up table is configured to select a first value at a first torque value and a second value at a second torque value.

* * * * *